United States Patent [19]

Ingoglia

[11] 4,428,268

[45] Jan. 31, 1984

[54] SELF-CONTAINED GUITAR AMPLIFICATION SYSTEM

[76] Inventor: Joseph E. Ingoglia, 5564 Whitby Rd., Baltimore, Md. 21206

[21] Appl. No.: 358,742

[22] Filed: Mar. 16, 1982

Related U.S. Application Data

[63] Continuation of Ser. No. 69,248, Aug. 23, 1979, abandoned, which is a continuation-in-part of Ser. No. 952,922, Oct. 19, 1978, abandoned.

[51] Int. Cl.[3] ..... G10D 1/08; G10G 7/00; G10H 3/18

[52] U.S. Cl. ..... 84/1.16; 84/267; 84/453; 84/465; 179/182 A; 181/131; 181/137; 181/141

[58] Field of Search ..... 84/1.16, 267, 453, 465; 179/182 A; 181/131, 137, 141

[56] References Cited

U.S. PATENT DOCUMENTS

| | | | |
|---|---|---|---|
| 3,829,624 | 8/1974 | Goodin et al. | 179/182 A X |
| 3,910,376 | 10/1975 | Azneer | 181/131 |
| 3,951,230 | 4/1976 | Littmann | 181/131 |
| 4,064,965 | 12/1977 | Brown | 181/131 |
| 4,112,809 | 9/1978 | Sjöstrand et al. | 84/465 |
| 4,232,582 | 11/1980 | Diamond | 84/267 |

*Primary Examiner*—Stanley J. Witkowski
*Attorney, Agent, or Firm*—Walter G. Finch

[57] ABSTRACT

The invention is an improved amplification system for guitars that does not require electrical energy. The system is self-contained and intended for use by the guitarist to listen to the music that he produces on an electrical-type guitar without connection to an electronic-type amplification system. The guitarist can use it during practice or for personal enjoyment without the sound reaching others in the nearby vicinity of the guitarist. The system provides a pick-up piece on the guitar, a connecting pick-up piece for the main sound transmittal tubes, sound transmittal tubes, and an insulated headset.

10 Claims, 5 Drawing Figures

SELF-CONTAINED GUITAR AMPLIFICATION SYSTEM

This is a continuation of continuation-in-part application Ser. No. 69,248, filed Aug. 23, 1979, now abandoned of parent application Ser. No. 952,922 filed Oct. 19, 1978, now abandoned.

BACKGROUND AND SUMMARY OF THE INVENTION

The invention relates to amplification systems and in particular to amplification systems for electrical-type guitars; specifically, an amplification system that is self-contained for use by the guitarist to listen to the musical sounds that he produces without the sound being generally audible to those in the near vicinity.

Many guitarists playing electrical-type guitars would like to practice or to personally enoy the guitar music which then play without the need for connecting up to a standard or specialized electronic amplification system. Such systems are expensive, require electrical energy to operate, and are generally disruptive to those in the nearby vicinity who may be carrying on general conversation or other activities.

Unlike the regular guitar, the electrical-type guitar does not emit generally audible sounds. Thus, guitarists normally must rely on electronic sound amplification equipment when practicing or playing electrical-type guitars.

In the present invention, the sound is picked up from a regular musical instrument from the top of the instrument by a specifically placed pick-up plate and then transmitted by a mating pick-up plate, having a special connection structural means, and transmitting the sound through a special structure for a listening means.

The present invention provides a means whereby the individual guitarist can listen to the sounds of the electrical-type guitar that he is playing for practice or for personal enjoyment. The guitarist alone can hear the sound without those in the vicinity being disturbed. For the guitarist using the device and system of this invention the sound is amplified for the guitarist's hearing only.

It is, therefore, an object of the invention to provide an amplification system for electrical-type guitars that is self-contained.

It is a further object of the invention to provide an amplification system for electrical-type guitars that can be heard only be the guitarist using the system.

It is another object of the invention to provide an amplification system for electrical-type guitars that is simple to install on the guitar.

It is still another object of the invention to provide an amplification system for electrical-type guitars that is easily connected and disconnected for use.

It is yet another object of the invention to provide an amplification system for electrical-type guitars that operates without the use of electrical energy.

It is also an object of the invention to provide an amplification system for electrical-type guitars that produces no generally audible sound to those in the vicinity of the guitar player.

It is still a further object of the invention to provide an amplification system for electrical-type guitars that a guitarist can use for practice or personal enjoyment of the music that he produces.

It is yet still another object of the invention to provide an amplification system for electrical-type guitars that amplifies for the guitarist's hearing only.

Further objects and advantages of the invention will become more apparent in the light of the following description of the preferred embodiments.

DESCRIPTION OF THE PREFERRED EMBODIMENTS

Figure 3:
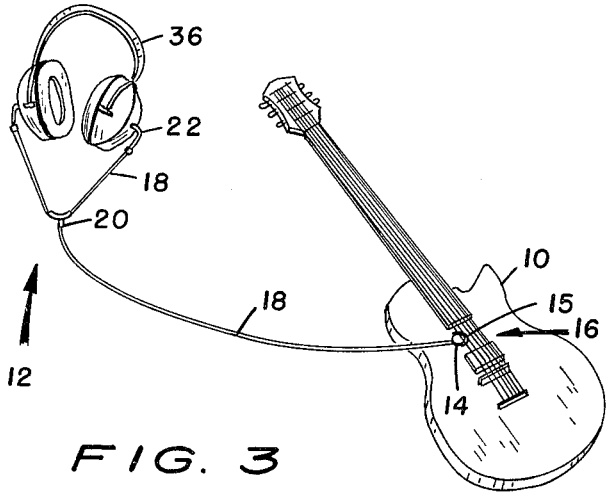
FIG. 3 is a pictorial view of the amplification system connected to an electrical-type guitar.

Referring to the drawings and particularly to FIG. 3, an improved amplification system for electrical-type guitars is shown at 12.

The amplification system as shown in FIG. 3 consists of a guitar pick-up plate 15 on the guitar 10, a transmittal pickup plate 14 on the guitar end of the main portion of the sound transmittal tubes 18, the sound transmittal tubes 18, a bifurcated connection 20 to divide the main portion of the sound-transmittal tube 18 into two leads (one for each ear piece 28 described later), a pair of transmittal tube connectors 22 and a headpiece 36 joining and holding the two ear pieces 28 so that the ear pieces 28 and the headpiece 36 form a headset that can be affixed to the head. The ear pieces 28 being similar to an ear phone type, but of a special unique and novel structure of this invention, described hereinafter.

The guitar pick-up plate 15 may be located at any area 16 on the body of the guitar where it will pick up the vibrations. The guitar pick-up plate 15 picks up vibrations when the guitar 10 is played by the guitarist. The vibrations of the electrical type guitar are hardly discernable in an audible manner without some form of amplifIcation. With the amplification system 12 of the present invention in use, the electrical-type guitar 10 takes on the nickname of the silent guitar when it is being played. When an electric-type guitar is amplified in the usual manner it is extremely loud.

As the vibrations of the guitar 10 being played are picked up by the guitar pick-up plate 15, they are transmitted to the transmittal pick-up plate 14. The vibrations, in the form of amplified musical sound, travel from the transmittal pick-up plate 14 up to the main portion of the sound transmittal tube 18, said sound transmittal tube 18 being flexible and rubber-like.

As the amplified musical sound travels up the main portion of sound transmittal tube 18, the bifurcated connection 20 divides the sound to flow up the two leads of the sound transmittal tube 18. The divided sound then travels to the pair of transmittal tube connectors 22 which connects the two leads of the sound transmittal tube 18 to the two ear pieces 28. The guitarist, wearing the headset, thus hears the amplified musical sound which he is producing on the guitar 10.

It is to be noted that the combination of the special pick-up plates 15, the transmittal pick-up plate 14, the tube system 18 and its connections, and the very special ear pieces 28, described in detail hereinafter, is unlike a stethoscope and not comparable with it in structure or operation.

It is to be noted that configuration of the guitar pick-up plate 15 and the transmittal pick-up plate 14 may be round, square, rectangular, or any other shape and such variation of the configuration is within the scope and intent of the invention. Both the guitar pick-up plate 15 and the transmittal plate 14 are shown round on the drawings.

The method of attachment of the guitar pick-up plate 15 to the guitar may be by adhesive, clamp, or attached by bolt or screw method. Such variations are within the scope and intent of the invention.

It is important to note that the guitar pick-up plate 15 is attached direct to the top area of the guitar 10 body, and transmits them directly to the transmittal pick-up plate 14 affixed closely to it.

Figure 4:
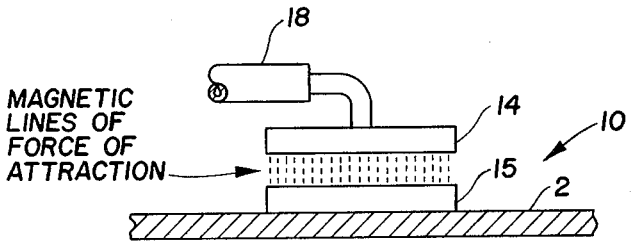
FIG. 4 is a side view of magnetically attracted pick-up plates.
Figure 5:
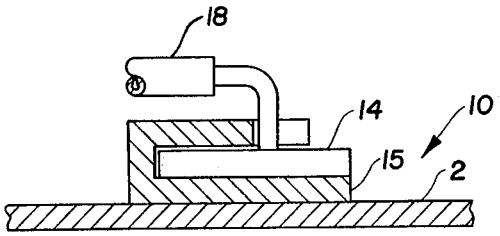
FIG. 5 is a partial sectional view of a quick coupling means for pick-up plates.

The transmittal pick-up plate 14 is affixed to the guitar pick-up plate 15 to receive the vibrations for transmittal. This affixing of the transmittal pick-up plate 14 to the guitar pick-up plate 15 may be done by clamping the two together, by making them magnetically attractive to each other, as shown in FIG. 4, or by providing a means for making a quick coupling means for coupling the two pick-up plates together as shown in FIG. 5. Regarding the latter quick coupling means, one method is shown in FIG. 5 and provides a slotted arrangement on the top side of the guitar pick-up plate 15 into which the transmittal pick-up plate 14 can be placed from an open end in the slotted arrangement. This quick coupling means is made with a sliding neat fit between the guitar pick-up plate 15 and the transmittal pick-up plate 14 so that it literally snaps into place in a secured manner.

The sound transmittal tube 18 is tube-like and may be rubber, plastics, or any other suitable flexible material. The main portion of the sound transmittal tube 18 between the transmittal pick-up plate 14 and the bifurcated connection 20 may be uncoiled or coiled for flexibility, it is shown uncoiled on the drawing. The sound transmittal tube 18 is attached to the transmittal pick-up plate 14 by a tube-like projection of the transmittal pick-up plate 14.

Figure 1:
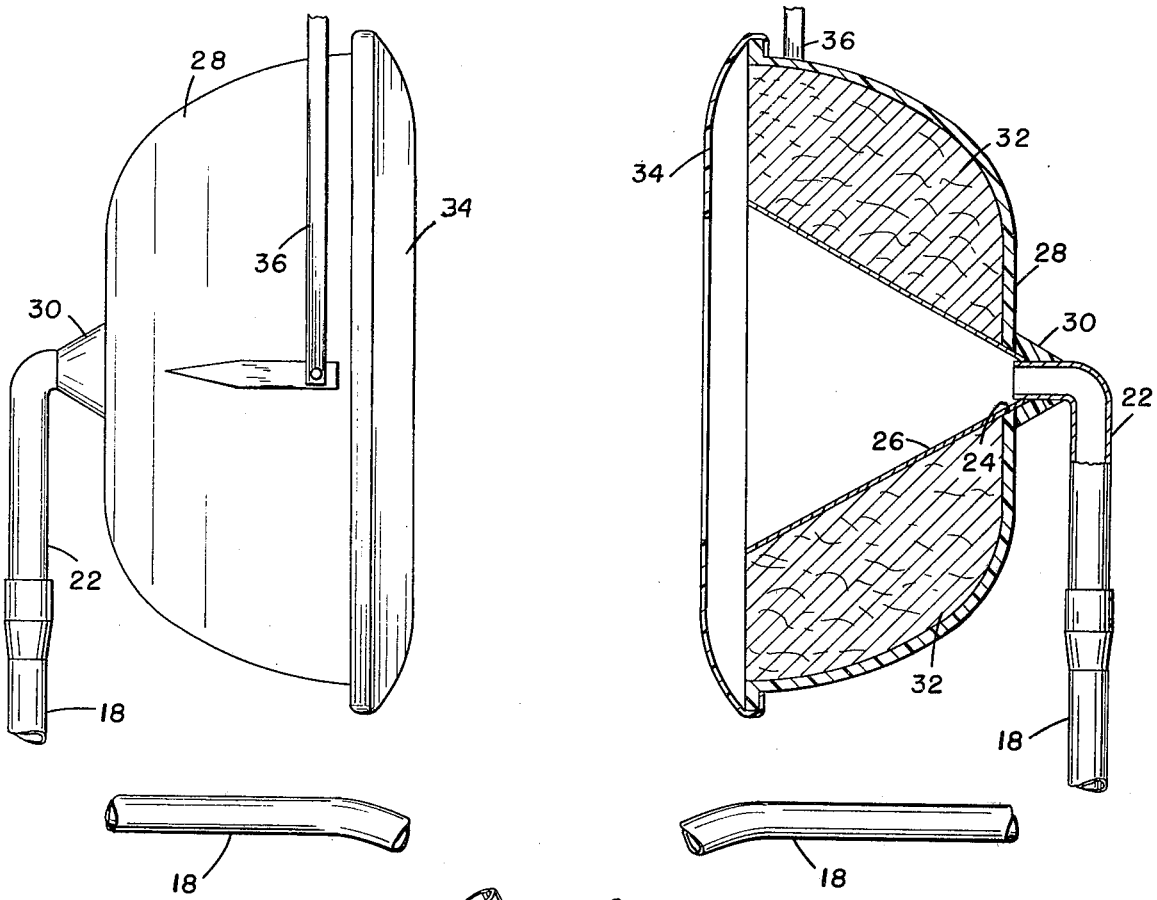
FIG. 1 is a general view of a self-contained amplification system, showing the elements of the structure, with a portion shown in sectional view.

FIG. 1 shows the aforementioned elements of the structure in general relation to each other (the transmittal pick-up plate 14, the sound transmittal tube 18 and its two leads from the bifurcated connection 20 and the pair of transmittal tube connectors 22). The transmittal tube connectors 22 are attached to the ear pieces 28 by epoxy 30 or other suitable adhesive, solder, or the like. The connection of the transmittal tube connectors 22 to the ear pieces 28 are made at the opening 24 in the outside shell of each ear piece 28.

Figure 2:
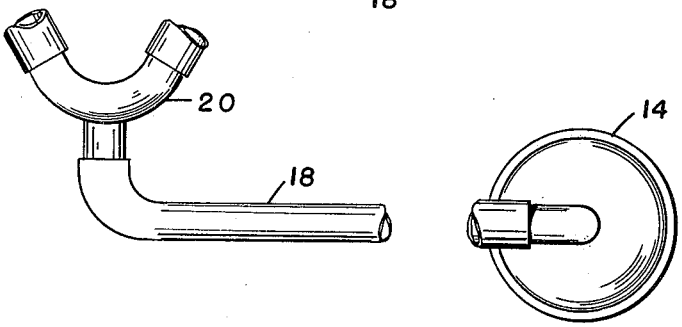
FIG. 2 is a side view of an ear piece with a portion shown as a partial sectional view.
Figure 2:
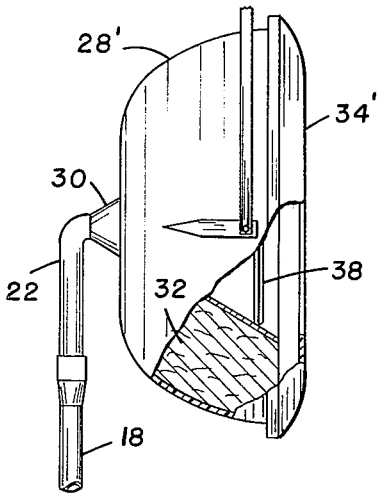

A sound cone 26 leads from the opening 24 to the final sound amplifier 38 (See FIG. 2). The cover 34 on the ear piece 28 having an open center therein fits over the ear of the guitarist when the headset is worn. The cover 34 is soft and flexible to provide a more or less sound-proof interface with the users head. The headpiece 36 holds the two ear pieces 28 in related position to fit the ears and joins them to form the headset. Insulation 32 around the sound cone 26 fills the cavity between the sound cone and the outside cup-like shell of the ear piece 28 and insulates the ear from extraneous outside noises when the amplification system is in use. More important, the insulation 32 assures the perfect sound transmission of the sound cone 26. It is to be noted that the ear piece structure is operable without the final sound amplifier 38. The unique and novel structure makes this possible.

The headpiece 36 is made of spring-like material to make is stiffly flexible and keep it gently against the ears of the user. The headpiece 36 is hinged at the ear pieces 28 so that it may be worn across the top of the head, across the back of the head, or under the chin. The headpiece may be made adjustable and such an adjustable feature is within the scope and intent of the invention.

The design of the structure of the ear pieces 28 is unique and novel in that the sound cone 26 amplifies the sound transmitted through the aforementioned tube 18 of the transmittal means. The specific shape of the sound cone 26 and its complete insulation 32 amplifies the sound sufficiently and clearly so that the final amplifier 38 is not required, but is added for refinement if needed. The structure of the earpiece 28, including the sound cone 26 and its insulation 32, was especially created for this invention.

As can be readily understood from the foregoing description of the invention, the present structure can be configured in different modes to provide the ability to transmit the amplified sound from an electrical-type guitar to the ears of a user.

Accordingly, modifications and variations to which the invention is susceptible may be practiced without departing from the scope and intent of the appended claims.

What is claimed is:

1. In an electrical guitar, said electrical guitar having a body means and strings as parts thereof, said body means having a top portion thereof, said top portion being located immediately under said strings, a self-contained guitar amplification system, comprising:

a first sound pick-up means, said first sound pick-up means being suitably and securely affixed to the exterior surface of said top portion of said body means of said electrical guitar, said first sound pick-up means being disc-like in configuration and magnetic, said magnetic disc-like first sound pick-up means having a magnetic quality, said first sound pick-up means being capable of picking up sound vibrations from said exterior surface of said body means when said guitar is played;

a second sound pick-up means, said second sound pick-up means having a first side and a second side, said first side being placed upon said first sound pick-up means, said second sound pick-up means being disc-like in configuration and magnetic, said magnetic disc-like second sound pick-up means having a magnetic quality, said magnetic quality of said first and second sound pick-up means causing said disc-like first and second pick-up means to be magnetically attracted to each other and to be magnetically affixed securely to each other, said second sound pick-up means being capable of picking up receiving, and transmitting said sound vibrations received from said first sound pick-up means by contact therewith, said second sound pick-up means having a tube-like means projecting from said second side thereof;

a transmission tube means, said transmission tube means being removably affixed to said tube-like means on said second sound pick-up means, said transmission tube means receiving and transmitting therethrough said sound vibrations received from said second sound pick-up means;

a pair of listening means, said listening means being removably affixed to said transmission tube means, said listening means being of a configuration to cover the ears of a quitarist, said listening means receiving said sound vibrations from said transmission tube means and transmitting said sound vibrations to the ears of said guitarist.

2. A self-contained guitar amplification system as recited in claim 1, wherein said transmission tube means comprises:

a first transmission means, said first transmission means being of tube configuration, said first transmission means being flexible and of rubber-like consistency, said first transmission means being affixed to said tube-like means projecting from said second sound pick-up means, said first transmission means and said tube-like means having an interior and an exterior, said interior of said first transmission means of tube configuration communicating with said interior of said tube-like means projecting from said second pick-up plate;

a bifurcated connection means, said bifurcated connection means providing a first and second connection means, said bifurcated connection means having a third connection means centered thereon, said first, second and third connection means having an interior and an exterior, said first transmission means of tube configuration communicating with said interior of said third connection means and thereby communicating with said interior of said first and second connection means of said bifurcated connection means;

a second transmission means of tube configuration, said second transmission means of tube configuration being flexible and of rubber-like consistency, said second transmission means of tube configuration being affixed to said first connection means of said bifurcated connection means, said second transmission means having an interior and an exterior, said interior of said second transmission means of tube configuration communicating with said interior of said bifurcated connection means;

a third transmission means of tube configuration, said third transmission means of tube configuration being flexible and of rubber-like consistency, said third transmission means of tube configuration being affixed to said second connection means of said bifurcated connection means, said third transmission means having an interior and an exterior, the interior of said third transmission means of tube configuration communicating with the interior of said bifurcated connection means;

a pair of tube connection means, each of said pair of tube connection means having a first end and a second end, one of said pair of tube connection means being affixed at the first end thereof to said second transmission means, and the other of said pair of tube connection means being affixed at the first end thereof to said third transmission means, said pair of tube connection means having an interior and an exterior, said interiors of said pair of tube connecting means communicating with the interiors of said second and third transmission means respectively.

3. A self-contained guitar amplification system as recited in claim 2, wherein each listening means of said pair of listening means comprises:

a shell means, said shell means being of cup-like configuration, said shell means having an open top and a bottom portion with a peripheral wall therearound, said shell means having an aperture opening centrally located in said bottom portion;

a sound cone means, said sound cone means being of funnel-like configuration, said sound cone means having an interior and an exterior, said sound cone means having a large diameter open end and a small diameter open end, a peripheral wall forming said funnel-like configuration, said sound cone means being centrally located within said shell means, said small diameter open end of said sound cone means extending through said opening in bottom of said shell means with said peripheral wall of said sound cone means adjacent to said small diameter open end interfacing with said opening in bottom portion of said shell means, said small diameter open end being connected and suitably affixed in a permanent manner to said second end of one of said pair of tube connection means, the interior of said sound cone means communicating through small diameter open end with the interior of said tube connection means, said sound cone means being permanently affixed to the exterior of said shell means at said opening in said shell means;

insulation, said insulation being packed into the interior cavity created by and between said sound cone means and said shell means;

an ear piece cover, said ear piece cover being soft and flexible, said ear piece cover being affixed to said open top of said shell means in the manner of a lid thereon, said ear piece cover having an aperture in the center thereof so that the interior of the ear of a guitarist communicates with the interior of said sound cone.

4. A self-contained guitar amplification system as recited in claim 3 and additionally, a sound amplification disc, said sound amplification disc being inserted in and affixed to the interior of said sound cone means substantially adjacent to said large diameter open end thereof.

5. A self-contained guitar amplification system as recited in claim 4 and additionally, a head-piece, said head-piece being band-like, said head-piece joining together said pair of listening means to form a head-set, said head-piece being spring-like and stiffly flexible, said head-piece being adjustable for size, each end of said head-piece being affixed to one of said pair of listening means, said head piece being hinged at each listening means.

6. In an electrical guitar, said electrical guitar having a body means and strings as parts thereof, said body means having a top portion thereof, said top portion being located immediately under said strings, a self-contained guitar amplification system, comprising:

a first sound pick-up means, said first sound pick-up means being suitably and securely affixed to the exterior surface of said top portion of said body means of said electrical guitar, said first sound pick-up means being of a female snap-type configuration for quick coupling, said first sound pick-up means being disc-like configured and having a slotted cavity on one side thereof, said slotted cavity having an interior surface and an opening at one end thereof, said first sound pick-up means being capable of receiving and picking up sound vibrations from said exterior surface of said body means when said guitar is played, said female snap-type configuration being said slotted cavity, said slotted cavity being located on the exposed side of said first sound pick-up means opposite to side securely affixed to said top portion of said body means;

a second sound pick-up means, said second sound pick-up means being of a male snap-type configuration for quick coupling, said second sound pick-up means being disc-like configured, said disc-like sound pick-up means having a first side and a second side, said first and second sides being exterior surfaces of said disc-like sound pick-up means, said second sound pick-up means having a tube-like means projecting from said first side thereof, said second sound pick-up means being slidably and removably affixed to said first sound pick-up means by removably and slidably inserting said second sound pick-up means into said slotted cavity of said first sound pick-up means through said opening at one end thereof, the exterior surface of said first and second sides of said second sound pick-up means meeting and interfacing with the interior surface of said slotted cavity of said first sound pick-up means, said meeting and interfacing of said first sound pick-up means with said interior surface of said slotted cavity being a close fitted sliding snap-in fit, said close fitted sliding snap-in fit removably affixing said first and second sound pick-up means securely to each other, said second sound pick-up means being capable of receiving and picking up and transmitting said sound vibrations received from said first sound pick-up means by contact therewith;

a transmission tube means, said transmission tube means being removably affixed to said tube-like means on said second sound pick-up means, said transmission tube means receiving and transmitting therethrough said sound vibrations received from said second sound pick-up means;

a pair of listening means, said listening means being removably affixed to said transmission tube means, said listening means being of a configuration to cover the ears of a guitarist, said listening means receiving said sound vibrations from said transmission tube means and transmitting said sound vibrations to the ears of said guitarist.

7. A self-contained guitar amplification system as recited in claim 6, wherein said transmission tube means comprises:

a first transmission means, said first transmission means being of tube configuration, said first transmission means being flexible and of rubber-like consistency, said first transmission means being affixed to said tube-like means projecting from said second sound pick-up means, said first transmission means and said tube-like means having an interior and an exterior, said interior of said first transmission means of tube configuration communicating with said interior of said tube-like means projecting from said second pick-up plate;

a bifurcated connection means, said bifurcated connection means providing a first and second connection means, said bifurcated connection means having a third connection means centered thereon, said first, second, and third connection means having an interior and an exterior, said first transmission means of tube configuration communicating with said interior of said third connection means and thereby communicating with said interior of said first and second connection means of said bifurcated connection means;

a second transmission means of tube configuration, said second transmission means of tube configuration being flexible and of rubber-like consistency, said second transmission means of tube configuration being affixed to said first connection means of said bifurcated connection means, said second transmission means having an interior and an exterior, said interior of said second transmission means of tube configuration communicating with said interior of said bifurcated connection means;

a third transmission means of tube configuration, said third transmission means of tube configuration being flexible and of rubber-like consistency, said third transmission means of tube configuration being affixed to said second connection means of said bifurcated connection means, said third transmission means having an interior and an exterior, the interior of said third transmission means of tube configuration communicating with the interior of said bifurcated connection means;

a pair of tube connection means, each of said pair of tube connection means having a first end and a second end, one of said pair of tube connection means being affixed at the first end thereof to said second transmission means, and the other of said pair of tube connection means being affixed at the first end thereof to said third transmission means, said pair of tube connection means having an interior and an exterior, said interiors of said pair of tube connecting means communicating with the interiors of said second and third transmission means respectively.

8. A self-contained guitar amplification system as recited in claim 7, wherein each listening means of said pair of listening means comprises:

a shell means, said shell means being of cup-like configuration, said shell means having an open top and a bottom portion with a peripheral wall thereearound, said shell means having an aperture opening centrally located in said bottom portion;

a sound cone means, said sound cone means being of funnel-like configuration, said sound cone means having an interior and an exterior, said sound cone means having a large diameter open end and a small diameter open end, a peripheral wall forming said funnel-like configuration, said sound cone means being centrally located within said shell means, said small diameter open end of said sound cone means extending through said opening in bottom of said shell means with said peripheral wall of said sound cone means adjacent to said small diameter open end interfacing with said opening in bottom portion of said shell means, said small diameter open end being connected and suitably affixed in a permanent manner to said second end of one of said pair of tube connection means, the interior of said sound cone means communicating through small diameter open end with the interior of said tube connection means, said sound cone means being permanently affixed to the exterior of said shell means at said opening in said shell means;

insulation, said insulation being packed into the interior cavity created by and between said sound cone means and said shell means;

an ear piece cover, said ear piece cover being soft and flexible, said ear piece cover being affixed to said open top of said shell means in the manner of a lid thereon, said ear piece cover having an aperture in the center thereof so that the interior of the ear of a guitarist communicates with the interior of said sound cone.

9. A self-contained guitar amplification system as recited in claim 8 and additionally, a sound amplification disc; said sound amplification disc being inserted in and affixed to the interior of said sound cone means substantially adjacent to said large diameter open end thereof.

10. A self-contained guitar amplification system as recited in claim 9 and additionally, a head-piece, said head-piece being band-like, said head-piece joining together said pair of listening means to form a head-set, said head-piece being spring-like and stiffly flexible, said head-piece being adjustable for size, each end of said head-piece being affixed to one of said pair of listening means, said head piece being hinged at each listening means.

* * * * *